US005391962A

United States Patent [19]

Roberts et al.

[11] Patent Number: 5,391,962

[45] Date of Patent: Feb. 21, 1995

[54] ELECTRON BEAM DRIVEN NEGATIVE ION SOURCE

[75] Inventors: Thomas G. Roberts; Michael J. Lavan; Brian R. Strickland, all of Huntsville, Ala.

[73] Assignee: The United States of America as represented by the Secretary of the Army, Washington, D.C.

[21] Appl. No.: 912,477

[22] Filed: Jul. 13, 1992

[51] Int. Cl.[6] ..... H01J 27/02; H05H 1/24

[52] U.S. Cl. ..... 313/362.1; 250/427; 315/111.81

[58] Field of Search ..... 313/362.1; 250/423 R, 250/424, 427; 315/111.81, 111.91

[56] References Cited

U.S. PATENT DOCUMENTS 3,702,973 11/1972 Daugherty et al. ..... 331/94.5 PE
4,559,477 12/1985 Leung et al. ..... 250/427 X

OTHER PUBLICATIONS

J. R. Hiskes et al., "Analysis of the $H_2$ Vibrational Distribution in a Hydrogen Discharge," Applied Physics Letter, vol. 54, No. 6, Feb. 6, 1989, pp. 508–510.

J. R. Hiskes, "Review of Progress in the Theory of Volume Production," presented at the 4th Intl Symposium on the Production and Neutralization of Negative Ions and Beams, Brookhaven National Lab, Oct. 27–31, 1986, pp. 1–13, Oct. 24, 1986.

J. G. Alessi et al., "The BNL Toroidal Volume H− Source," 1991 Particle Accelerator Conference, San Francisco, Calif., May 6–9, 1991.

*Primary Examiner*—Sandra L. O'Shea

*Attorney, Agent, or Firm*—Hugh P. Nicholson; Freddie M. Bush

[57] ABSTRACT

A negative ion source is disclosed wherein an electron beam produced in one chamber is used to sustain a discharge in another chamber whose conditions are independently adjusted for optimum production of vibrationally excited hydrogen molecules. By including a provision for an independently controlled source of low energy electrons in a region near the extraction aperture, the optimum conditions for creation of H− ions by dissociative attachment are produced. In this manner the current and brightness of a H− beam may be maximized.

4 Claims, 2 Drawing Sheets

ELECTRON BEAM DRIVEN NEGATIVE ION SOURCE

DEDICATORY CLAUSE

The invention described herein may be manufactured, used, and licensed by or for the Government for governmental purposes without the payment to us of any royalties thereon.

BACKGROUND OF THE INVENTION

Negative ions, such as $H^-$ and $D^-$, have many useful applications in high-energy accelerators and plasma fusion devices for diagnostics, neutral beam heating, and current drive. The most recent high energy accelerator applications have been for neutral particle beam (NPB) weapon systems where negative ions are produced, accelerated to high energies, directed toward a target, and neutralized by stripping the excess loosely bound electrons so that they propagate toward the target, through the earth's magnetic field, as a neutral beam. A very low emittance beam is required for the beam to be of a reasonable size (about the size of the target) at a distant target.

This need for low emittance, high brightness beams places severe requirements on the accelerator, magnetic optics, neutralizer, and in particular, the ion source. If the beam is not degraded and current is not lost in accelerating the beam, then the output brightness of the system will be close to that produced by the ion source. The current and emittance can never be any better than that produced by the ion source.

The normalized root-mean-square emittance ($\epsilon_{n,rms}$) at the ion source is given by $$\epsilon_{n,\,rms} = (r/2)\sqrt{kT_i/mc^2} \tag{1}$$

where r is the radius of the extraction aperture, k is Boltzmann's constant, $mc^2$ is the ion rest energy, and $T_i$ is the temperature of the negative ions just after extraction from the plasma in the ion source. Equation (1) is just an expression of the Heisenberg uncertainty principle, since $(T_i)^{\frac{1}{2}}$ is proportional to the random momentum of the negative ions in the beam and r is proportional to its uncertainty in position. The brightness, B, is then given by $$B=I/\pi\epsilon^2=4Imc^2/\pi r^2kT_i=(4mc^2/k)(J/T_i) \tag{2}$$

where I is the current and J is the current density.

Two types of sources are being used for NPB weapons technology development. Surface plasma sources, which produce high brightness beams but only for short pulses and low duty factors, and multicusp chamber or so-called "bucket" type volume sources that operate continuously (CW), but have yet to produce high brightness beams. It appears that neither of these sources, as now configured, will meet the brightness requirements for an advanced neutral particle beam weapon system, nor does it appear that any reasonable modification of these configurations will lead to the desired source.

To produce an ion source that meets or exceeds the required brightness levels, it will be necessary to make a somewhat radical departure from established approaches without losing sight of the lessons learned from these previous efforts. In any negative ion source, there are mechanisms or reactions that produce the negative ions and processes that destroy them. The number of negative ions per unit volume is the result of a balance between those constructive and destructive processes. At the extraction aperture, where the useful beam is generated, the extraction itself becomes one of these destructive or loss mechanisms, and the only negative ions that can be extracted are those that are formed within one mean free path of the most dominant loss mechanism. Therefore, the optimum ion source will consist of independent mechanisms for maximizing the desired conditions. The negative ion production process that yields the lowest temperature ions in a CW source must be maximized while also minimizing the conditions for the process that most quickly destroys them. These conditions need only be produced and maintained near the extraction aperture.

The lowest temperature negative ions are produced by dissociative attachment of low energy electrons to hydrogen molecules in high vibrational states, $$e_1^- + H_2^* \rightarrow H_2^- \rightarrow H^- + H \tag{3}$$

where $H_2^*$ is a hydrogen molecule that is vibrationally excited. In equilibrium, the two dominant destruction processes are collisional detachment caused by fast electrons $$e_f^- + H^- \rightarrow 2e^- + H \tag{4}$$

and associative detachment $$H + H^- \rightarrow H + H + e_1^- \tag{5}$$

However, during extraction, after the $H^-$ ions have been accelerated somewhat, collisional stripping $$H^- + H_2 \rightarrow H + H_2 + e^- \tag{6}$$

can also be a significant loss mechanism and, in some sources, collisions with walls may play a part in the kinetics as is disclosed by J. R. Hiskes and A. M. Karo, "Analysis of the $H_2$ Vibrational Distribution in a Hydrogen Discharge," Applied Physics Letters 54(6), Feb. 6, 1989, pages 508–510.

Existing multi-chamber sources produce the vibrationally excited $H_2$ molecules in one chamber by use of a low voltage (approximately 100 volts), high current (several hundred amps) discharge. A second chamber is produced by the use of a magnetic filter that prevents the high energy electrons from entering this second chamber. Low energy electrons cross the filter field, possibly as negative ions produced in the first chamber near the filter. Another possibility is that the low energy electron travels in conjunction with a positive ion across the magnetic filter and therefore the pair appears as a neutral entity. This indicates that $H^+$ and $H_2^+$ production may also be important to carry low energy electrons into the second chamber in these sources. After entering the second chamber, these electrons become detached from the ions and produce the low temperature plasma found there.

The $H^-$ ions formed in the second chamber are then extracted to form the negative ion beam. The discharge in the first chamber produces not only the desired vibrationally excited $H_2$ molecules, but also many other species such as H, $H_2^+$, and $H_3^+$ that can cross the magnetic filter and contribute to the reactions that occur in the extraction chamber in an undesirable way. This limits the brightness that can be obtained from these sources as is noted by J. R. Hiskes, "Review of Progress in the Theory of Volume Production" in a paper presented in the Fourth International Symposium on the Production and Neutralization of Negative Ions and Beams, Brookhaven National Laboratory, Oct. 27-31, 1986.

The surface plasma sources also utilize a low voltage, high current arc that must be confined to a region near a cesiated converter surface. This makes these sources more complicated and even more difficult to use and understand than the multi-chamber CW sources.

The use of a low voltage, high current discharge in all these sources means that their most sensitive parameter, the ratio of the electric field (E) to the number of particles per cubic centimeter (n), cannot be optimized simultaneously for both desired discharge operation and production of $H^-$ ions. The operation of the arc or discharge is critically dependent on this ratio (E/n), and the population of the $H_2$ molecules in the highly vibrationally excited states is even more sensitive to E/n, as evidenced by the increase in $H^-$ current with an increase in arc power. The range of values of E/n for which the arc operates satisfactorily is far from the optimum value for the excitation of $H_2$ to high vibrational states by collisions with fast electrons. Therefore, in the conventional sources, the best operating conditions are established by a tradeoff between the two conflicting requirements on the arc power and the $H_2$ pressure or flow rate. An ideal source would allow for these two requirements on E/n to be optimized independently.

SUMMARY OF THE INVENTION

The electron beam driven negative ion source sustains a discharge that can otherwise be independently adjusted to optimally produce vibrationally excited hydrogen molecules and wherein an independently controlled source of low energy electrons is provided in a region near the extraction aperture so that the optimum conditions for the production of $H^-$ ions due to dissociative attachment are created in the extraction region as desired for the production of very bright negative ion beams.

DESCRIPTION OF THE PREFERRED EMBODIMENT

The electron beam driven negative ion source provides a negative ion source wherein population of the $H_2$ vibrationally excited molecules and the concentration of low energy electrons in the neighborhood of the extraction aperture may be optimized independently. It also provides an ion source that produces the maximum current of $H^-$ ions at the lowest ion temperature, that is, the brightest negative ion beam that can be extracted from a plasma. To do this, the electron beam driven negative ion source creates a discharge that produces vibrationally excited $H_2$ molecules in large quantities without also producing (or the need to produce) large concentrations of $H^+$, $H_2^+$, and $H_3^+$ ions. Because this ion source has an independent source of low energy electrons, $e_1$, production of $H_2^*$ can be maximized and undesirable products such as $H^+$, $H_2^+$, and $H_3^+$, can be minimized. This allows more $H_2^*$ to interact with $e_1$ to produce $H^-$.

Figure 1:
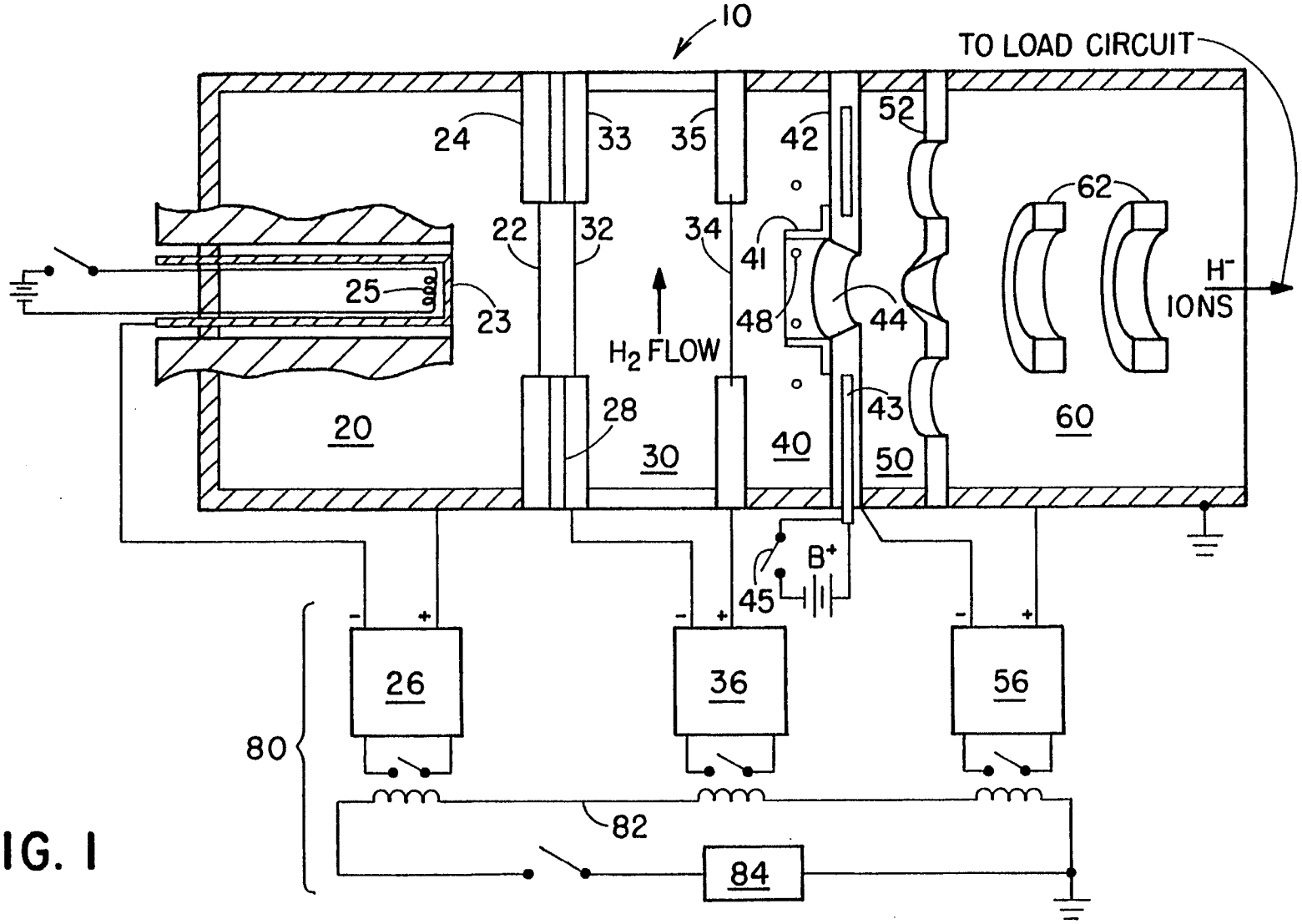
FIG. 1 is a schematic cross-sectional view of an ion source in accordance with this invention.
Figure 3:
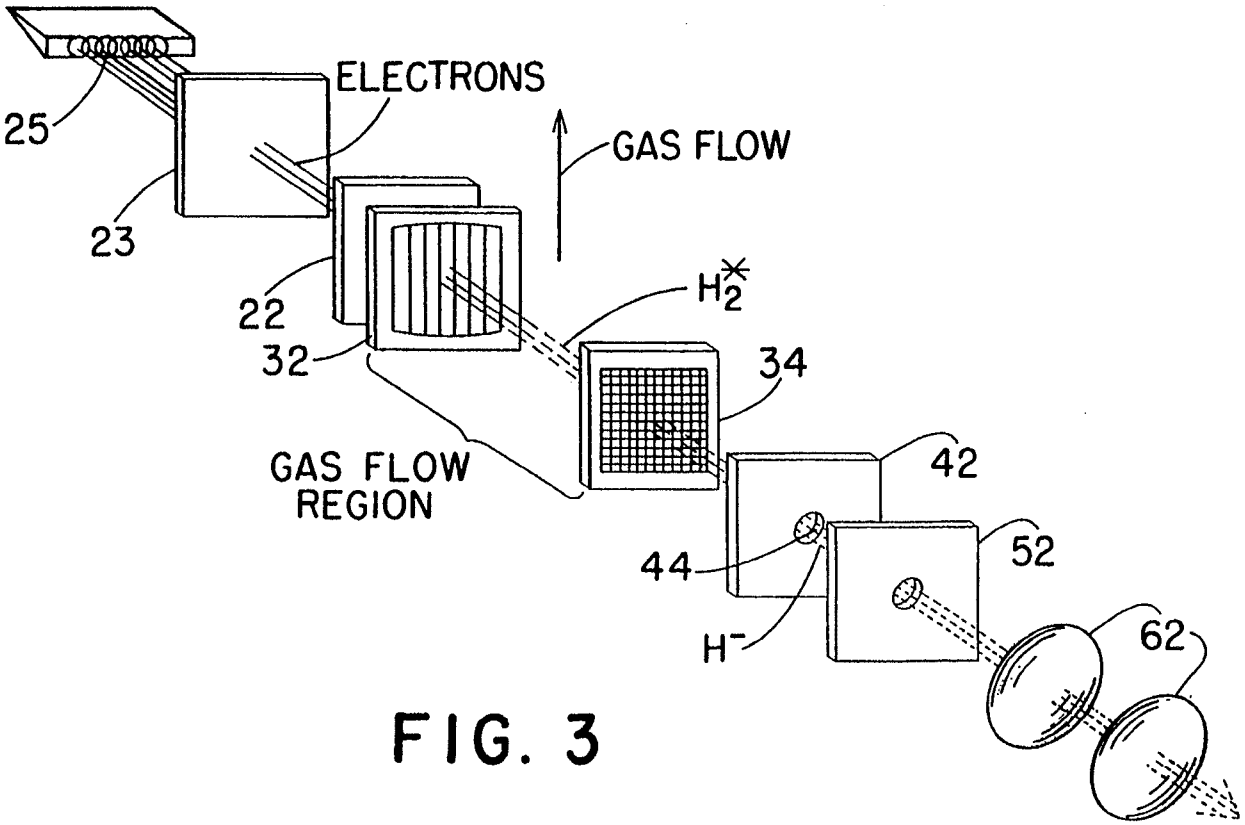
FIG. 3 is a perspective diagrammatic view illustrating the various electrodes associated with electron generation, gas flow, $H_2^*$ generation and finally $H^-$ ion production.
Figure 2:
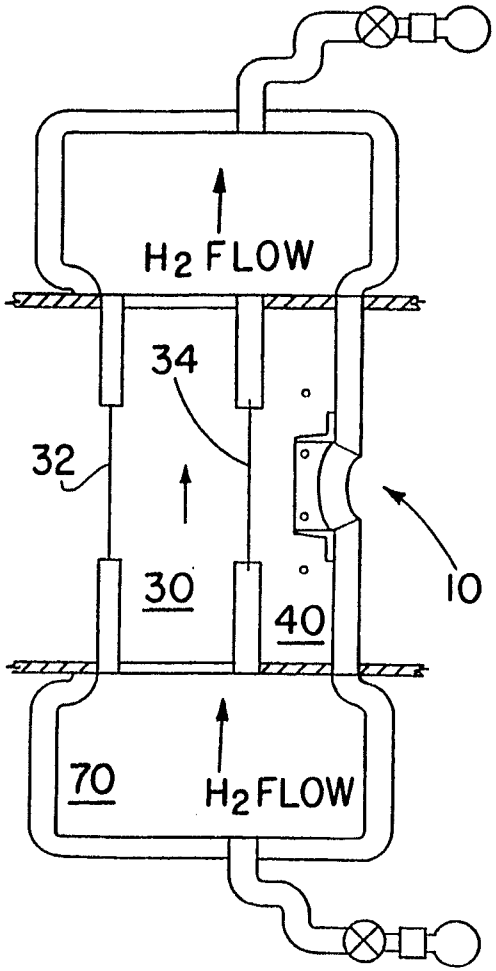
FIG. 2 is another schematic cross-sectional view of a portion of the ion source illustrating the $H_2$ gas flow system.

Referring now to the drawings wherein like numbers refer to like parts, FIGS. 1-3 show various details of the electron beam driven negative ion source apparatus 10. The apparatus 10 comprises an electron gun 20, a sustainer discharge chamber 30, a filtered negative ion production chamber 40, an ion extraction region 50, a negative ion beam transport chamber 60, a $H_2$ gas circulating system 70 (FIG. 2), and the associated electric power supply circuitry 80. The electron gun 20, the sustainer discharge chamber 30, and the $H_2$ gas flow 70 are similar to those used in some electric discharge lasers (for example U.S. Pat. No. 3,702,973 issued Dec. 14, 1972) except that very broad electron beams and extremely uniform discharges, along with the problems associated with obtaining them, are not required for operation of the electron beam driven negative ion source.

The electron gun region 20, in which a vacuum is maintained by pumps (not shown) is electrically isolated from the sustainer discharge chamber 30 by the insulator 28 and pressure isolated by a grid supported thin film 22 and its support structure 24. The discharge chamber 30 is located between electrode 32 and a similar electrode 34. These electrodes are wire or tube grids. The current in this discharge is driven by a power supply 36, and this current flows only when high energy electrons, which pass through the thin film 22, are supplied by the electron gun 20. The thin film grids 32 and 34 are reticulated or transparent to atomic particles and are supported respectively by conductive support structures 33 and 35. The negative ion production chamber 40 is defined by electrode 34 and the negative ion extraction electrode 42. The electrode 42 may be biased at a small positive voltage with respect to electrode 34, and an array of magnetic filter rods 48 within chamber 40 may be at the same potential as grid 34. The negative ion extraction chamber 50 is defined by electrodes 42 and 52, with electrode 52 being at the ground potential. The negative ions are extracted at an energy of several 10's of KeV by applying a potential of several 10's of kilovolts between electrodes 42 and 52. This voltage is supplied by power supply 56. The relatively low pressure in the negative ion extraction chamber 50 and the ion beam transport chamber 60 is maintained by pumps according to routine procedure and are not shown on the drawings. The negative ion beam ($H^-$) from the ion beam transport chamber 60 is injected into a load or an accelerator (not shown) such as a radio frequency quadrupole (RFQ) accelerator for high energy particle or fusion energy applications. The beam shaping optics elements 62, shown for guiding the ion beam in the ion beam transport chamber 60, may be either magnetic or electrostatic.

The electron gun 20 is similar to that of a X-ray machine or that of a $CO_2$ electric discharge laser welder. Electrons are generated at the cathode 23 by thermionic emission from the low work function coating on the cathode 23. A heater 25 is used to heat the cathode. These electrons are then accelerated toward the anode 22 by power supply 26, where they gain just enough energy to pass through the thin film 22 and the gas in chamber 30. The thin film anode 22 separates chamber 20, which is under a vacuum or negative pressure P ($P=10^{-6}$ Torr), from chamber 30 which contains $H_2$ gas at a pressure of approximately 10 mTorr. There is very little force on anode 22 due to this pressure differential and anode 22 may be carbon foil like those used in NPB neutralizers only somewhat thicker. These high energy electrons, whose energy has been adjusted by power supply 26 so that their range in chamber 30 is equal to the separation between film 22 and film 34, ionize the gas in chamber 30 producing low energy electrons, which inherently renders the gas conducting. The magnitude of the conductivity is determined by the high energy electron current that passes through film 22. This current level is controlled by the temperature of cathode 23.

The voltage between films or electrodes 32 and 34 is adjusted so that the average energy gained by an electron between collisions is just equal to the energy for which the cross-section for excitation of the $H_2$ molecules to a vibrationally excited state is a maximum. In this manner, nearly all of the energy supplied by power supply 36 goes initially into the vibrational states of the $H_2$ gas, thus optimizing the production of $H_2$ molecules that are vibrationally excited. This energy remains in the vibrational mode for only a short time called thermolization time (approximately 1000 collision times) before it is shared with the rotational and translational modes. The $H_2$ gas flows through cavity 30 so that the gas in 30 is exchanged in a time somewhat less than this thermolization time. The $H_2^*$ molecules, which are electrically neutral, pass through the electrode 34, and fill chamber 40. Chamber 40 is separated into two parallel regions substantially normal to the electron/ion flow path by the magnetic filter rods 48. The magnetic filter may be created by rods 48 as is done in some current volume ion sources, or by some external magnets as is done in other existing volume sources. In the electron beam driven negative ion source the filter, whose purpose is to prevent fast electrons from entering the space near electrode 42, may not be necessary as electrode 34 may serve this purpose. However, the filter rods are included since they also serve to prevent the low energy electrons produced at electrode 42 near the extraction region from escaping this area. The extraction region is the region immediately behind aperture 44. Low energy or slow electrons are created in the region near the extraction aperture 44 by thermionic emission from a low work function material on protrusion 41 of electrode 42. This protrusion substantially defines the boundary of the extraction region. Protrusion 41 may by cylindrical or conical. The amount of these low energy electrons is controlled by a heater 43, which is embedded in the electrode 42 and coupled to a direct current power supply B+ by switch 45.

The conditions for optimum production of $H^-$ ions by the reaction $$e_1^- + H_2^* \rightarrow H^- + H \quad (7)$$

now exist in the desired area near the extraction aperture. The concentration of $H_2^*$ is optimally produced in chamber 30 where the discharge conditions for conductivity and vibrational excitation of the $H_2$ molecules are independently controlled, and the concentration of slow electrons is created independent of the conditions in chamber 30 by thermionic emission from 41. The extraction electrode 52 and its power supply 56 are of a type well known in the art and may include additional electrostatic accelerating electrodes not shown.

It is to be understood that the word hydrogen is to include molecules of all of its isotope ($H_2$, $D_2$, and $T_2$). Other atoms such as lithium ($Li^-$) may also be included.

Electric power circuitry 80 (FIG. 1) shows power supplies 26, 36, and 56 which are typical high voltage power supplies for driving the respective components. They can be manually turned on in numerous ways. As shown they are switched on and off at the same time by a series relay or coil arrangement 82 controlled by a single switched power supply 84.

Obviously many modifications and variations of the present invention are possible in the light of the above teachings. It is therefore to be understood that within the scope of the appended claims the invention may be practiced otherwise than as specifically described.

We claim:

1. In negative ion generation, a method for generating a negative hydrogen ion beam comprising the steps of:

directing an electron beam at low energy along an axial flow path toward a first chamber for interaction with hydrogen gas therein;

accelerating said low enemy electron beam to high energies sufficiently for the beam to pass into said first chamber, ionize gas in the chamber and render the gas conductive;

stimulating sustained release of vibrationally excited hydrogen molecules along the axial path;

directing hydrogen gas flow through said first chamber normal to the electron beam flow path for independently controlling conductivity and vibrational excitation of the hydrogen molecules;

guiding said excited hydrogen molecules from said first chamber into an ion production chamber bounded by first and second electrode grids normal to the axial flow path for extracting a hydrogen ion beam therefrom;

providing magnetic filtering in said ion production chamber adjacent to said second electrode to capture extraneous low energy electrons in the region;

providing interaction between said excited hydrogen molecules with low energy electrons within said ion production chamber; and directing said negative hydrogen ion beam from said ion extraction region through a beam shaping region for injection into a load or an accelerator.

2. A negative ion source comprising:

generating means for providing a high energy electron beam output, a beam sustainer discharge chamber having an ionizable gas therein, a filtered negative ion production chamber, an ion extraction region, and a negative ion beam transport chamber arranged in series, coaxial alignment so that said high energy electron beam is injected into said sustainer discharge chamber for ionizing and stimulating vibrationally excited molecules in said gas therein and guiding a flow of said excited molecules into said negative ion production chamber; said production chamber extracting a negative ion beam from said flow of excited molecules and directing said negative ion beam from said production chamber into said ion extraction region, and said ion beam directing means lying adjacent to said extraction means for scanning, shaping, and transporting said negative ion beam as an output beam for input to using systems; wherein said high energy electron beam generating means is an electron gun assembly having a thermionic cathode emitter and wherein said cathode emitter is stimulated to emit a controllable low energy electrons according to cathode temperature, said low energy electrons are accelerated to become said high energy electron beam which enters said sustainer discharge chamber, ionizing the gas in the chamber and rendering the gas conductive, the magnitude of conductivity and the related number of low energy electrons produced is a function of the electron beam current entering the discharge chamber.

3. A negative ion source as set forth in claim 2 wherein said ionizable gas is taken from the group consisting of hydrogen, hydrogen isotopes and lithium.

4. A negative ion source as set forth in claim 2 and further comprising a gas circulating system coupled to said sustainer discharge chamber for constantly flowing said ionizable gas therethrough for interaction with said low energy electrons to optimally produce vibrationally excited gas molecules.

* * * * *